United States Patent [19]

Isenmann

[11] 3,979,934

[45] Sept. 14, 1976

[54] SEPARABLE KEY HOLDER

[75] Inventor: Robert L. Isenmann, St. Louis, Mo.

[73] Assignee: Penn Corporation, Princeton, N.J.

[22] Filed: May 14, 1975

[21] Appl. No.: 577,238

Related U.S. Application Data

[63] Continuation-in-part of Ser. No. 507,727, Sept. 20, 1974, abandoned.

[52] U.S. Cl. ..... 70/459; 24/230 CF

[51] Int. Cl.[2] ..... A47G 29/10

[58] Field of Search ..... 70/459, 457, 456 R, 70/45 B; 150/40; 24/230 F, 230 SC, 230 CF

[56] References Cited

UNITED STATES PATENTS

| | | | |
|---|---|---|---|
| 3,600,917 | 8/1971 | Krock | 70/459 |

FOREIGN PATENTS OR APPLICATIONS

| | | | |
|---|---|---|---|
| 200,594 | 6/1920 | Canada | 70/459 |
| 1,465,611 | 12/1966 | France | 70/457 |

*Primary Examiner*—Robert L. Wolfe

*Attorney, Agent, or Firm*—John D. Pope, III

[57] ABSTRACT

A releasable key ring connector comprises plug and socket members shaped to fit together snugly but to separate upon pressure placed on one of them. Key supporting means on each member accommodate separate key rings.

6 Claims, 7 Drawing Figures

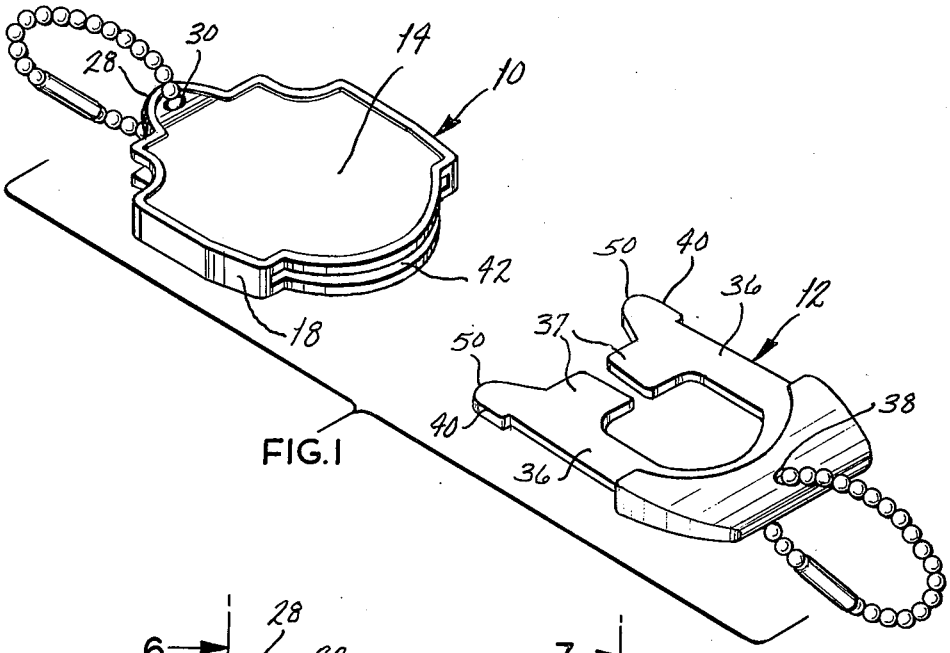
FIG. 1
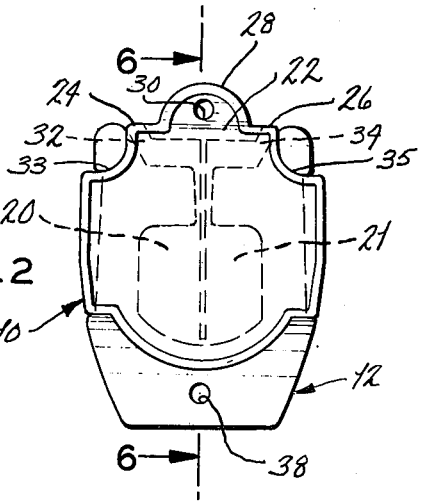
FIG. 2
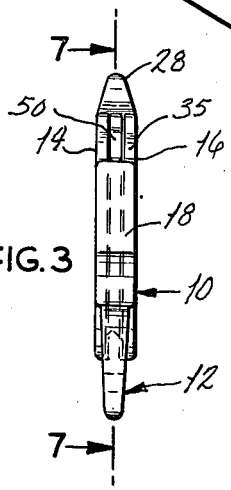
FIG. 3
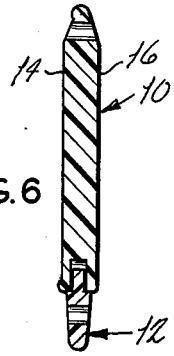
FIG. 6
FIG. 4
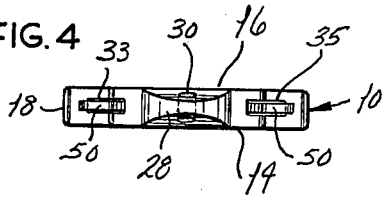
FIG. 5
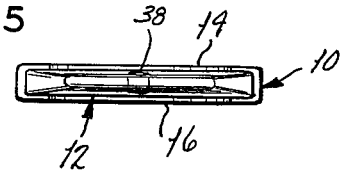
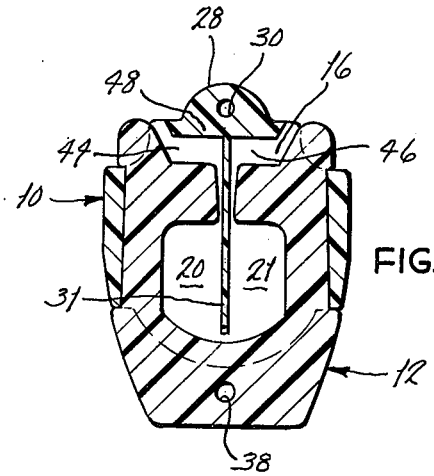
FIG. 7

SEPARABLE KEY HOLDER

This application is a continuation-in-part of my copending application Ser. No. 507,727, filed Sept. 20, 1974 and now abandoned.

Key holders of many types have been provided which permit placement of keys thereupon and removal therefrom as desired by the user. Many users have considered it important, however, to segregate their keys between those which relate to an automobile, for example, and the remainder. Separate key rings are commonplace and some separable rings and separable connectors are known.

Among the objects of this invention are the provisions of a releasable key ring connector which is easily constructed of inexpensive materials; the provision of a connector of the type indicated which quickly and surely releases when this is desired but which remains connected until the release mechanism is actuated; and the provision of a connector of the type indicated which is simple in construction and both simple and reliable in operation over long periods of time. Other objects and features will be in part apparent and in part pointed out hereinafter.

The invention accordingly comprises the constructions hereinafter described, the scope of the invention being indicated in the following claims.

In the accompanying drawings, in which one of various possible embodiments of the invention is illustrated, FIG. 1 is a perspective of the connector of the present invention with its parts separated;

FIG. 2 is a plan with the parts fitted together;

FIG. 3 is a side elevation of FIG. 2;

FIG. 4 is an end elevation looking from the top of FIG. 2;

FIG. 5 is an end elevation looking from the bottom of FIG. 2;

FIG. 6 is a section taken on the line 6—6 of FIG. 2; and

FIG. 7 is a section taken on the line 7—7 of FIG. 3.

Corresponding reference characters indicate corresponding parts throughout the several views of the drawings.

Referring now to the drawings, a socket member 10 cooperates with a plug member 12 to form the connector of the present invention. Socket 10 is preferably formed of a suitable rigid plastic material which can be formed into the desired shape. It has a slab-shaped body with front wall 14 and back wall 16 joined by narrow sides 18. Socket 10 is formed with a central cavity divided into two segments 20 and 21, each of which narrows as it approaches end 22 of socket 10. Side walls 18 bend at 24 and 26 so as to meet at end 22 in a projection 28 which contains a key ring hole 30. Cavities 20 and 21 are separated by a wall 31 which extends from end 22 to a location short of the opening at end 42. Cavity 20 connects the opening at end 42 with small opening 32 while cavity 21 connects the large opening at end 42 with small opening 34. Small openings 32 and 34 are located in the portions 33 and 35 of side walls 18 which bend toward each other and act as the other end of the connector.

Plug 12 which is C-shaped includes arms 36 which meet and have a key ring hole 38 at the apex. Each arm 36 terminates at a detent 40.

While socket 10 is formed of a plastic material which is rigid, plug 12 is preferably formed of a plastic material which is flexible but sturdy so that it may be flexed to a small extent many times without deterioration. Projections 37 on arms 36 act as stops to prevent overflexing and resulting damage to arms 36.

As indicated previously, cavities 20 and 21 join at a comparatively large opening in end 42 but each narrows as it approaches respectively opening 32 and opening 34. This is accomplished by converting each of cavity 20 and 21 into a passage 44 and 46, respectively, by a block 48 of plastic which connects to wall 31. Block 48 broadens as it approaches end 22.

Cavities 20 and 21 and plug 12 are sized so that arms 36 will enter cavities 20 and 21 under a small amount of compression and as plug 12 is pushed further into socket 10 the ends of C-shaped plug 12 bring detents 40 to openings 32 and 34. Since arms 36 are under compression while plug 12 is being inserted, they spring outwardly when openings 32 and 34 are reached, thereby engaging detents 40 with the edges of openings 32 and 34. These detents hold the connector firmly assembled until the ends 50 of each arm 36 are grasped and arms 36 compressed slightly. This releases detents 40 from the edges of openings 32 and 34 whereupon plug 12 can be readily pulled away from socket 10.

As will be apparent from the foregoing, the keys for an automobile, for example, can be attached to either the key ring on plug 12 or that on socket 10. The user's other keys can be attached to the other key ring. Because of the construction of the connector the two parts are readily separated when desired, thereby segregating one set of keys from the other.

The configuration of cavities 20 and 21 and more particularly that of wall 31 and block 48 perform a double function. When the two portions of the connector are assembled the construction aids in guiding arms 36 to their location with detents 40 engaging the edges of openings 32 and 34. When separation is desired however block 48 and wall 31 prevent the compression of arms 36 by the fingers of the user to a greater extent than required for operation of the device. This permits effective disengagement of detents 40 from the edges of openings 32 and 34 without danger of destructive stresses upon arms 36.

Instead of constructing plug 12 with detents on the sides of arms 36 so that they engage walls 18 when plug 12 is inserted in socket 10, detents 40 may be positioned on the ends of arms 36 with one detent on the face of one arm 36 and the other on the back of the other arm. This provides secure engagement of the detents with front and back walls 14 and 16 instead of side walls 18. When it is desired to disengage the plug from the socket the ends of arms 36 are grasped on the front and back and twisted to thereby bring detents 40 into alignment with openings 32 and 34 and permit the separation of the two parts. In this instance a twisting force is required from the user instead of a compressive force.

If desired, key ring holes 30 and 38 may be replaced with ring holes affixed respectively to end 28 of socket 10 and the apex of plug 12.

From the foregoing it will be apparent that applicant has provided a connector for holding two key rings yet providing for easy disassembly over numerous operations with ease and reliability. Because of the small number of moving parts, wear is minimized and the connector remains efficient for extended periods of use.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A releasable key ring connector comprising plug and socket members, the socket member comprising a slab-shaped elongated body with relatively wide front and back walls, relatively narrow side walls and relatively narrow first and second end walls, the first end wall having a large opening therein and the second end wall having two relatively small openings therein, a partition extending from the second end wall to adjacent the first end wall to form two body cavities between the first and second end walls, each cavity connecting the large opening to one of the small openings to permit passage between the large opening in the first end wall and one of the relatively small openings in the second end wall, each said body cavity decreasing in area between said large opening and the small opening to which it is connected, key supporting means on the end of the socket member adjacent the second end wall, the plug member having a resilient C-shaped body with detents at the end of each arm, the body being bifurcated to fit within said cavities with the detents positioned adjacent the openings in said second end wall when the plug is inserted in the socket and key supporting means on the plug member approximately equally remote from each of said detents.

2. A connector according to claim 1 in which each body cavity in the socket member decreases in size as it approaches an opening in the second end wall.

3. A connector according to claim 2 in which the arms of the plug member are finger compressible.

4. A connector according to claim 3 in which the arms of the plug member are each sized to fit within one of said body cavities.

5. A connector according to claim 4 in which the arms are sized to position said detents within the openings in said second end wall when the plug member is substantially fully inserted in the socket member.

6. A connector according to claim 5 in which at least one arm includes stop means to inhibit compression of the arms of said plug member beyond a predetermined point.

* * * * *